US007607631B2

(12) United States Patent
Newman

(10) Patent No.: US 7,607,631 B2
(45) Date of Patent: Oct. 27, 2009

(54) FRAME LEVELER

(76) Inventor: Arnold L. Newman, 8220 Hamilton Spring Ct., Bethesda, MD (US) 20817-2714

( * ) Notice: Subject to any disclaimer, the term of this patent is extended or adjusted under 35 U.S.C. 154(b) by 0 days.

(21) Appl. No.: 11/139,123

(22) Filed: May 28, 2005

(65) Prior Publication Data

US 2006/0278799 A1 Dec. 14, 2006

(51) Int. Cl.
*A47G 1/16* (2006.01)

(52) U.S. Cl. ..... 248/493; 248/466; 248/489; 248/544; 248/495; 248/331; 248/476; 248/477; 248/470; 248/490; 248/494; 248/497; 248/498; 40/617; 40/757; 33/333; 33/334; 33/613; 33/645

(58) Field of Classification Search ..... 248/466, 248/489, 544, 493, 495, 331, 476, 477, 470, 248/490, 494, 497, 498; 40/617, 757; 33/333, 33/334, 613, 645
See application file for complete search history.

(56) References Cited

U.S. PATENT DOCUMENTS

| | | | | | |
|---|---|---|---|---|---|
| 237,916 | A * | 2/1881 | Simpson | 248/493 |
| 351,673 | A * | 10/1886 | Vosburgh | 248/493 |
| 582,278 | A * | 5/1897 | Genereux | 248/492 |
| 763,448 | A * | 6/1904 | Winter | 248/493 |
| 888,182 | A * | 5/1908 | Mantenfel | 248/495 |
| 1,057,484 | A * | 4/1913 | Huber | 24/135 N |
| 1,579,357 | A * | 4/1926 | Grothe | 248/495 |
| 4,208,802 | A | 6/1980 | Berndt | |
| 4,212,123 | A | 7/1980 | Robin | |
| 4,244,549 | A * | 1/1981 | Oldfield | 248/494 |
| 4,364,538 | A | 12/1982 | Tomlinson | |
| 4,463,924 | A | 8/1984 | Conti | |
| 4,575,905 | A | 3/1986 | Torrey | |
| 4,944,094 | A | 7/1990 | Depiano et al. | |
| 5,743,507 | A * | 4/1998 | Rushing | 248/495 |
| 5,931,439 | A * | 8/1999 | Lemire | 248/493 |
| 5,947,438 | A | 9/1999 | Lemire | |
| 6,062,525 | A | 5/2000 | Lemire | |
| 6,527,244 | B1 | 3/2003 | Kamenstein et al. | |
| 2002/0125398 | A1 * | 9/2002 | Lemire | 248/493 |
| 2005/0139747 | A1 * | 6/2005 | Lemire | 248/493 |

FOREIGN PATENT DOCUMENTS

| | | |
|---|---|---|
| WO | WO98/24085 | 6/1998 |

* cited by examiner

*Primary Examiner*—J. Allen Shriver, II
*Assistant Examiner*—Nkeisha J Smith

(57) ABSTRACT

A frame leveler is disclosed that automatically levels picture frames, and mirror frames. A pivotable, weighted bob is used as a gravity reference to control a lock that unlocks the extension of a cable on the side of a frame that is tilted up with respect to the other side, when the frame is not level. The extensible cable is let out until the frame is once again level, at which point the extensible cable is locked and prevented from extending further. When the frame side is tilted down with respect to the other side, or the frame is level, the extensible cable is locked and prevented from extending on that side.

3 Claims, 9 Drawing Sheets

FRAME LEVELER

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND OF THE INVENTION

1. Field of the Invention

This invention relates to an apparatus and method for automatically leveling frames with respect to gravity. More specifically, it relates to using a gravitational reference, such as a bob, to determine a vertical direction with respect to gravity, which is used to adjust the angle of a frame suspended from a wall or ceiling, such as a picture frame, or the like, to make it level. Generally, it provides a convenient, automatic way to keep frames level, even as they tend to move due to environmental disturbances such as bumps, vibrations, moving air currents, and thermal effects.

2. Related Art

Frames that are suspended from walls and ceilings, such as picture frames, when first hung, and at various times thereafter, must be leveled or re-leveled so that the frame is parallel with respect to a reference. Usually, the plane of the floor or ceiling is chosen as a reference for leveling the top or bottom edge of a frame. Most often, visual inspection is used to level frames. Usually, one steps back from the frame after first hanging it, and then, from a distance, views it with respect to the floor, ceiling, or some other reference. Then one returns to the frame and adjusts it manually. Sometimes this process is repeated several times until the frame appears to be level. However, without using an instrument, such as a bubble level or some other instrument, visual inspection can only provide a rough approximation of the level orientation. Furthermore, this process requires that a person manually perform the steps necessary to level the frame.

Various inventors have approached this problem in two general ways: first, by equipping a frame or frame hardware with a level indicator or sensor, and, second, by devising means for easing the manual adjustment of the frame as it is suspended or hung. For example, U.S. Pat. No. 4,208,802, discloses a mounting plate that is attached to a picture frame and which holds a removable and disposable liquid bubble level. After the picture frame is leveled, the invention relies on friction or an adhesive to help keep the picture level. U.S. Pat. No. 4,944,094 describes a picture frame leveling tool that includes upper and lower visual level indicators for enabling the alignment of the picture relative to a supporting wall. PCT Application No. WO98/24085 discloses a picture frame with a spirit level built-in to a recessed portion of the frame. The level is not generally visible by the viewer of the picture, but is visible to the person leveling the picture, who sees it from above. The positioning device of U.S. Pat. No. 4,212,213 is a pivotally mounted indicator arm that is only visible from the front of the picture when the picture needs leveling.

A variety of ways have been devised to ease picture frame level adjustment. For example, U.S. Pat. No. 4,364,538 provides a picture hanging wire cable each end of which is looped through a screw eye on a picture frame, and connected back onto itself through a movable locking aperture. Wire length, and thus picture level, is adjusted manually by sliding either side of the wire cable locking aperture. U.S. Pat. No. 5,743,507 describes a picture hanging rod in association with a wall stud mounted baseplate. The rod has a hanging lug for carrying a suspension wire of a picture, mirror, or the like. The hanging stud can be adjusted through a 360 degree rotation. The adjustable picture hanging hook of U.S. Pat. No. 6,527,244 provides a toothed wheel that is received within a base with locking grooves, and which has an extending knob for hanging a picture. The level of the picture frame is adjusted by removing the picture frame and manually moving the knob an appropriate amount before re-hanging the frame. U.S. Pat. No. 6,062,525 discloses a picture frame hanger that uses two screws and two threaded holders that provide for continuously adjusting the vertical and horizontal position. A screwdriver is used manually to adjust the position of the screws. The picture frame hanger of U.S. Pat. No. 5,947,438 includes a threaded adjuster (U-shaped in cross-section) that receives a picture hanging wire or cord. Various configurations of the device provide for horizontal and vertical movement. The invention of U.S. Pat. No. 4,575,905 is a single piece cleating and clamping device used manually for securing and adjusting the effective length of wire used to hang a picture frame. U.S. Pat. No. 4,463,924 discloses a lockable picture hanging and straightening device for securing a picture to a wall. The device uses a reel and a line of adjustable length attached to a corner of a picture frame and adjusted manually until the picture is level.

None of these references discloses an automatic, self-leveling frame for pictures, mirrors, or other items that are suspended from a ceiling or hung on a wall. More specifically, once hung and leveled manually, none of the inventions of the cited references are able to re-level themselves automatically should they move out of a level orientation. Unlike the present invention, re-leveling in the above cited art requires human intervention.

3. Objects and Advantages

Accordingly, in contrast to the shortcomings and limitations of the related art, the present invention provides an apparatus and method for suspending or hanging a frame, such as for pictures, mirrors, and the like, that is automatically self-leveling with respect to a reference.

Therefore, it is an object of the present invention to provide for the self-leveling of a frame with respect to a reference without relying on a human being to make mechanical adjustments manually as indicated by a level indicator or sensor.

It is a further object of the present invention to simplify the process of leveling a frame, such as for a picture, mirror, and the like, by dispensing with the need for human observation and judgment in the leveling process.

It is a still further object of the present invention to level a picture frame, and the like, with respect to gravity by automatically locking the frame's orientation only when it is in a level position.

It is yet another object of the present invention to level a picture frame, and the like, with respect to gravity and to re-level the picture frame automatically if it should move out of a level position.

It is still another object of the present invention to keep a picture frame, and the like, locked in its orientation only if it is level with respect to gravity, and to unlock its orientation if it moves out of a level position with respect to gravity.

It is yet another object of the present invention to adjust the orientation of a frame with respect to gravity by causing the frame to move under the influence of gravity into a level configuration.

SUMMARY OF THE INVENTION

In accordance with the present invention, a frame leveler is provided that either supports a frame, such as a picture frame, mirror frame, or the like, or is incorporated into such a frame. The frame leveler uses at least one pivotable bob that, in operation, prevents movement due to gravity of one side of a suspended or hanging frame supporting support if that side is tilted down with respect to the other side or the frame is level. If the side is tilted up with respect to the other side, then the side of the support that is tilted up is allowed to move down.

The frame leveler of the present invention is comprised of a support with at least a top edge and a first and second side. Pivotably attached to the support is a pivotable bob that points in the direction of gravity. An extensible cable for suspending or hanging the frame leveler is attached at least to the first side of the support. A cable lock is attached to the support and cooperates with the pivotable bob and its orientation with respect to the support such that when the first side of the support is tilted up with respect to the second side of the support, the extensible cable is unlocked. The support can be attached to a frame, and thus support the frame, or it can be the frame itself.

The frame leveler is usually suspended on each of its two sides (i.e., right and left sides) by at least one extensible suspension cable and the extensible cable is locked or unlocked according to the orientation of the frame with respect to a pivotable bob, which points down in a direction parallel to the force of gravity. The pivotable bob is pivotably attached to a support, which supports the frame or is the frame itself. If the angle formed between the top edge of the frame to the right or left side of a line drawn down from the top edge parallel to the direction of gravity (i.e., parallel to the longitudinal direction of the pivotable bob with respect to gravity) and that line is 90 degrees or less (i.e., the side is tilted down with respect to the other side), then the cable is locked. If the angle formed between the top edge of the frame to the right or left side of the line drawn down from the top edge parallel to the direction of gravity and that line is greater than 90 degrees (i.e., the side is tilted up with respect to the other side), then the extensible cable on that side is unlocked and the frame leveler is able to move down on that side due to gravity pulling on the weight of the frame leveler and frame. Under the force of gravity, when the frame is not level, the weight of the frame leveler and frame causes the side of the frame leveler that has an angle greater than 90 degrees with respect to a line parallel to the direction of gravity to let out more extensible cable, thus lowering that side until a level condition is established and movement of the extensible cable is then locked.

DRAWINGS

DETAILED DESCRIPTION OF THE INVENTION

The particulars shown herein are by way of example and for purposes of illustrative discussion of the embodiments of the present invention. The description taken with the drawings make it apparent to those skilled in the art how the present invention may be embodied in practice.

Leveling a frame, such as for a picture, mirror, or the like, must be done when first hanging a frame from a wall or suspending one from the ceiling. With time, some frames that were initially level move to a new position and require re-leveling. This may be due to bumping, vibrations, air currents, thermal changes, or other mechanical effects. As such, there has long been a need for a simple mechanical apparatus and method by which a frame, such as for a picture, mirror, or the like, can maintain a level orientation with respect to a reference such as gravity, and do so without requiring the intervention of a person to re-adjust the frame to a level position. The present invention addresses this need.

Figure 1B:
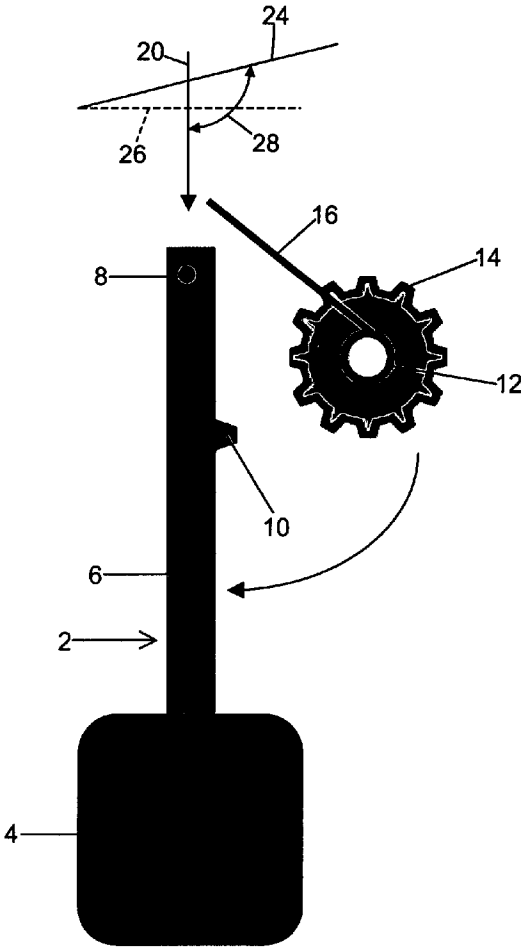
FIGS. 1A and 1B show the operation of the bob, lock and reel at two different angles of a frame.
Figure 1A:
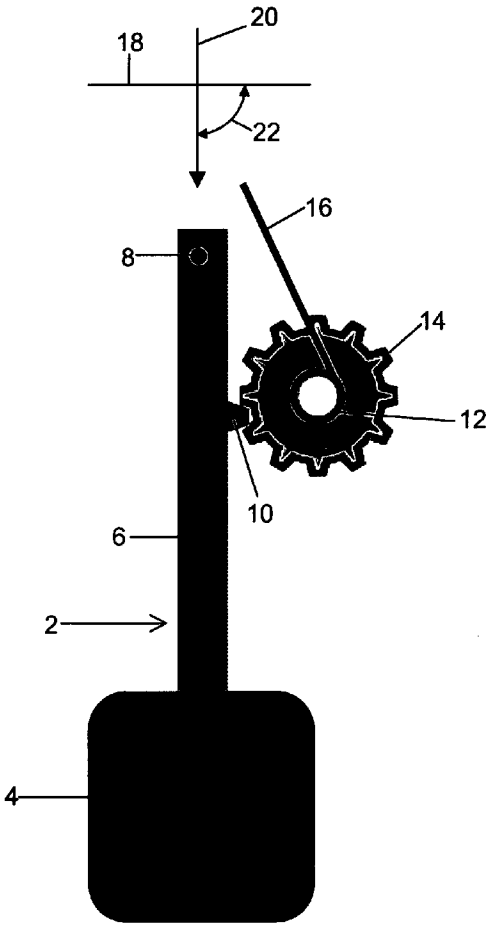

FIGS. 1A and 1B illustrate the basic operation of the present invention. In its simplest form, the invention operates to adjust the level of one side (right or left) of a frame, and thus, the level of a whole frame, when that side is oriented at an angle that is tilting up from level with respect to the other side of the frame. That is, the angle formed between the top of the frame on that side and a line pointing down parallel to the direction of gravity is greater than 90 degrees. For example, this is shown by angle 28 in FIG. 1B. In both Figures, bob 2 includes weight 4 attached to bob member 6, which is pivotably suspended from pivot 8, which is attached to a support (not shown). The support of the frame leveler typically has at least a top edge and two sides. As attached to the support, pivotable bob 2 freely moves so as to align or orient bob member 6 longitudinally parallel to the direction of gravity (i.e., down). Locking member 10 is attached to and extends generally laterally from bob member 6. Reel 12 is a take-up reel that can both take-up and let out cable 16, which is used to hang the frame from a wall or suspend it from a ceiling. Locking member 10 and bob member 6 constitute a gravity responsive lock for locking and unlocking cable 16. For the purposes of this invention, and as examples that are not meant to be limiting in any way to the scope of this invention, cable 16 can be a line, cable, rope, string, wire, cord, or the like, typically used in the art of frame hanging and suspension. It can also be a combination of these and other items. For example, a suspension wire can be attached to a plastic cord or strand to make a suspension cable. Reel 12 is rotatably attached to the support of the frame leveler and includes an internal spiral spring, not shown, that urges cable 16 to be taken up when the weight of the frame leveler and frame is lifted so as to relieve the tension of suspension of cable 16. Take up reels with internal spiral springs are well known in the mechanical art. For example, they are commonly incorporated into metal tape measure reels for taking up a metal tape measure that has been extended. Reel 12 also includes toothed gear 14, which is attached to, and concentric with, reel 12. As shown, reel 12 takes up cable 16 by turning in the clockwise direction. Reel 12 lets out cable 16 in the counterclockwise direction, but this is prevented when locking member 10 of bob member 6 is engaged with, and locking, gear 14, as is shown in FIG. 1A. Reel 12 can let out cable 16 only when gear 14 is free of locking member 10, as is shown in FIG. 1B. When cable 16 is let out due to the pull of gravity on the weight of the frame leveler, it increases the tension on the internal spiral spring (not shown) of take up reel 12. However, the tension on the internal spiral spring never becomes enough actually to support the weight of the frame leveler and frame. Therefore, as shown in FIG. 1B, locking member 10 of bob member 6 unlocks gear 14 when it is disengaged from gear 14, and gear 14 and take up reel 12 are free to rotate. If the weight of the frame is supported and lifted, thereby relieving the tension of suspension of the extensible cable 16, reel 12 rotates under the urging of the internal spiral spring in the clockwise direction and line 16 is taken up. If its weight is not supported, then, yet unlocked, as shown in FIG. 1B, reel 12 will turn in the counterclockwise direction, thereby letting out cable 16.

In FIG. 1A, the top of the frame is parallel to, and represented by, line 18, which, as shown, forms angle 22, which is a 90 degree angle (i.e., it is perpendicular) with line 20, which indicates the direction of gravity, and thus, the longitudinal direction of bob 2. Regardless of the orientation of the frame, bob 2 will always pivot so as to be parallel to the direction of gravity up to the point where locking member 10 engages gear 14. As shown, in FIG. 1A by line 18, the frame is level. When the frame is level, locking member 10 engages gear 14 and locks reel 12. If angle 22 is less than 90 degrees, then locking member 10 continues to lock gear 14. In this situation, the frame would be tilted down on the side suspended by the cable 16 as shown.

In FIG. 1B, the frame is not level, but tilted up on the side suspended by the line 16. In FIG. 1B, the top edge of the frame is represented by line 24, which, as shown, forms angle 28, which is greater than a 90 degree angle, with line 20, which indicates the direction of gravity, and thus, the longitudinal direction of bob 2. Dashed line 26 represents the level position of the frame that will be achieved by the operation of the invention. As shown in FIG. 1B, the frame is no longer level and locking member 10 as part of bob 2, by maintaining its orientation with respect to gravity, has pivoted away from gear 14 as indicated by the curved double arrow. Gear 14 is no longer engaged by locking member 10 and, thus, unlocked, is free to let out line 16. In this situation, cable 16 is let out, lowering the suspended side and pivoting bob 2 with respect to reel 12 to the point where locking member 10 once again engages gear 14, thereby locking it. When this happens, the top edge of the frame is parallel with dashed line 26 and the frame is level.

Typically, frames are hung with a single length of line, cable, wire, or the like, each end of which is secured to a first and second side (e.g., right and left) of the frame with the approximate middle of the length engaging a wall or ceiling hanger device. Sometimes frames are hung with two lengths of line, cable, wire, or the like, one per side (right and left), each suspended from its own wall or ceiling hanger device. The present invention will work with these configurations.

Figure 2A:
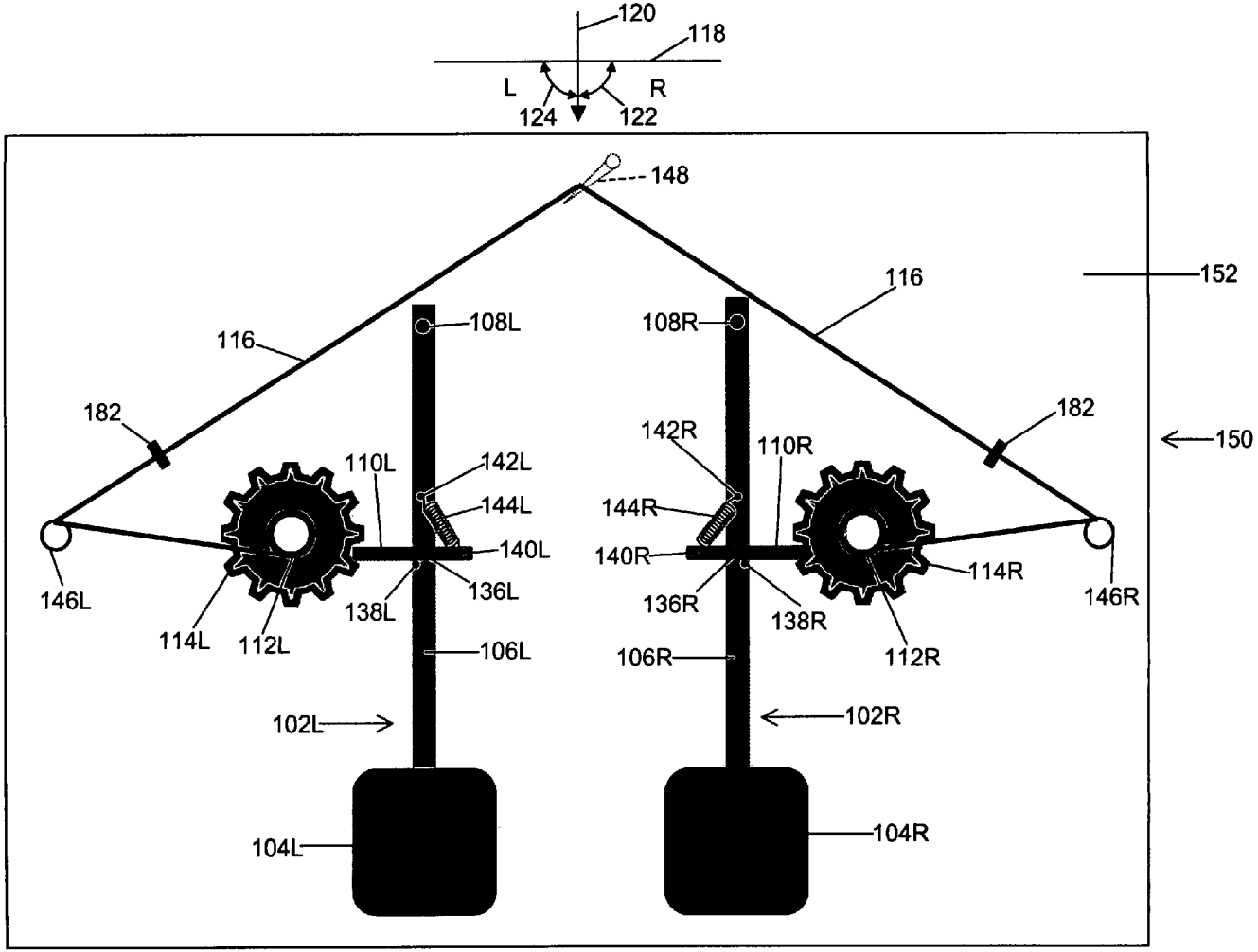
FIG. 2A shows the frame leveler with two locks, two reels, and two bobs with a frame in a level configuration.
Figure 2B:
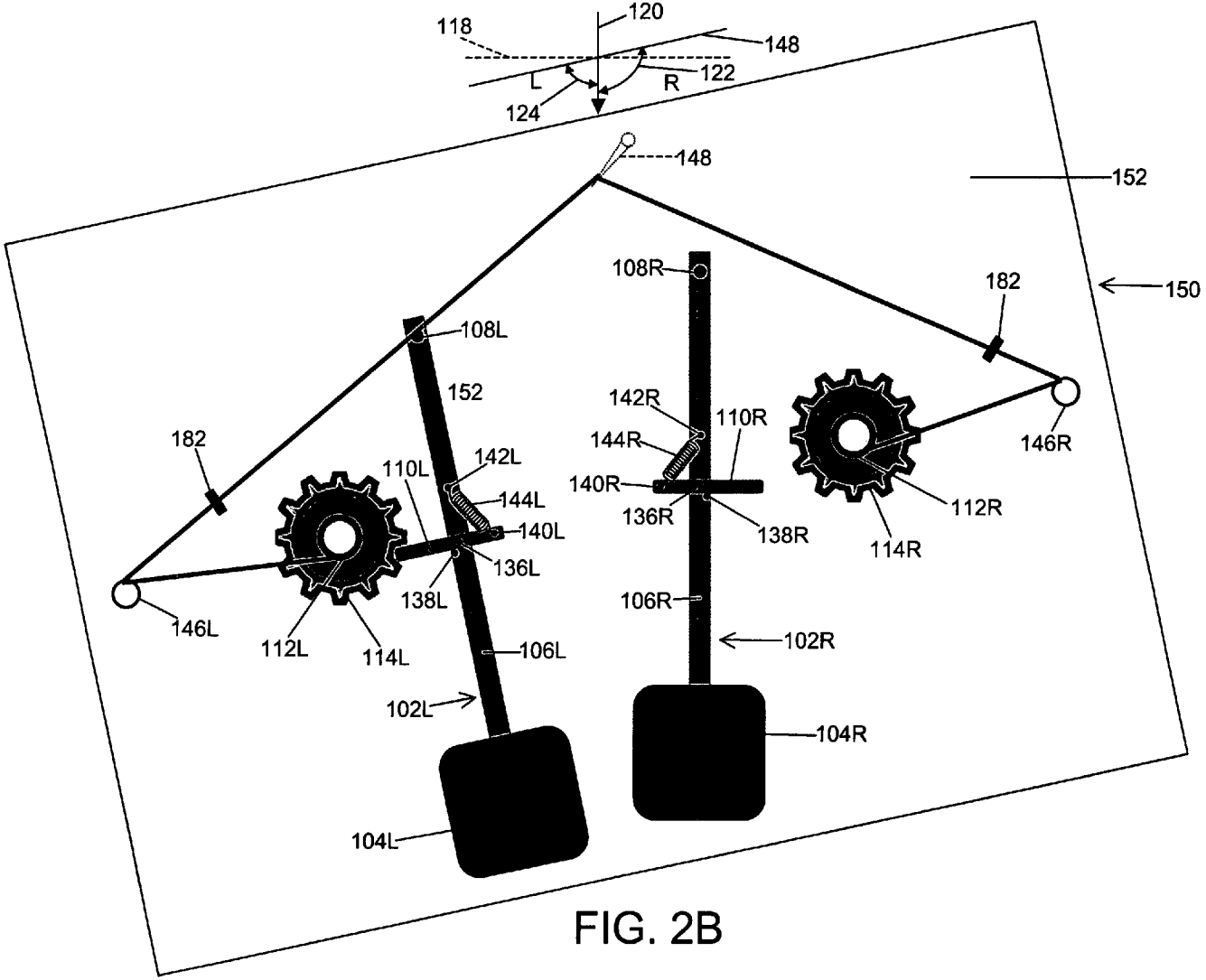
FIG. 2B shows the frame leveler with two locks, two reels, and two bobs with a frame that is not level.

FIGS. 2A and 2B show the operation of the present invention with a two-sided, two bob configuration, which is the preferred embodiment. In FIG. 2A, frame leveler 150 can be a picture frame, a mirror frame, or a separate frame-leveling module adapted to be attached to and level a picture frame, mirror frame, or the like. As shown, frame leveler 150 is suspended from a wall by cable 116, which engages wall hanger 148. Wall hanger 148 can be a nail driven into a wall (as shown), a hook, screw eye, bracket, or the like. As shown, cable 116 is a single line that extends from one side, up around wall hanger 148 to the other side of the frame. Alternatively, cable 116 could be two lengths of line, each connected to its own wall hanger. In the figures, item number suffixes L and R indicate left and right, respectively.

As shown in FIGS. 2A and 2B, the preferred embodiment includes two bobs, each generally indicated as item 102. More specifically, there is shown one bob, 102R on the right (R) side and another bob, 102L, on the left (L) side of the frame leveler. Each bob, 102L and 102R, includes a weight 104L and 104R, attached to bob members 106L and 106R, which are pivotably attached to the support 152 of the frame leveler 150 by pivots 108L and 108R, respectively. As such, each bob 102 freely moves on pivot 108 so as to seek to align or orient bob member 106 longitudinally parallel to the direction of gravity. Locking members 110L and 110R are attached to and extend generally laterally from bob members 106L and 106R, respectively. Locking members 110L and 110R are pivotally attached to bob members 106L and 106R by pivots 136L and 136R, respectively. On both left (L) and right (R) sides, locking member 110 is urged against stop 138 by spring 144, one end of which is attached to the medial end (with respect to frame leveler 150) of locking member 110 by lug 140. The other end of spring 144 is attached to bob member 106 by lug 142. Reels 112L and 112R are take-up reels that can both take-up and let out cable 116 from each side, which, as mentioned, is used to suspend frame leveler 150. Reels 112L and 112R are rotatably attached to the support 152 of the frame leveler 150 and include, within each, an internal spiral spring, not shown, that urges cable 116 to be taken up when the weight of the frame is lifted so as to relieve the tension of suspension of extensible cable 116. Cable stops 182 prevent the uneven uptake of cable 116. Reels 112L and 112R also include toothed gears 114L and 114R, which are attached to and concentric with reels 112L and 112R, respectively. Reels 112L and 112R with toothed gears 114L and 114R, when engaged with springably biased locking members 110L and 110R, in combination, function as ratchets and pawls to allow line 116 to be taken up by reels 112L or 112R when the frame leveler is lifted, but otherwise as locks to lock the reels 112L and 112R and prevent cable 116 from being let out. Reels 112L or 112R can let out cable 116 when gears 114L or 114R are free of locking members 110L or 110R. This occurs on a side when either of the bob members 106L or 106R are pivoted away with respect to reels 112L or 112R and locking member 110L or 110R no longer engages gear 114. In that case, gear 114 and its associated reel 112 is unlocked.

In FIG. 2B, the left side (L) of frame leveler 150 is tilted down from a level orientation with respect to the right side (R) of the frame leveler 150. Concomitantly, the right side (R) of frame leveler 150 is tilted up from a level orientation with respect to the left side (L) of the frame leveler 150, and right locking member 110R has pivoted away with respect to right reel 112R and no longer engages and locks gear 114R. Under the weight of frame leveler 150, reel 112R lets out cable 116 through screw eye 146R until locking member 110R re-engages and locks gear 114R, at which point reel 112R is again locked and frame leveler 150 is level as shown in FIG. 2A. Throughout this dynamic process, locking member 110L stays engaged with gear 114L and reel 112L continues to be locked. Therefore, in this example, only the right side of the frame leveler 150 is lowered by the extension of cable 116 on the right side (R) through the operation of the leveling apparatus of the present invention to re-establish a level condition. An analogous process to that already described occurs if frame leveler 150 should be tilted away from level condition in the opposite direction, that is, tilted up on the left side (L) with respect to the right side (R) of the frame leveler 150.

In FIG. 2A, the level condition is indicated by line 118, which is perpendicular to line 120, and which indicates the direction of gravity. In the level condition, the top edge of the frame is perpendicular to the direction of gravity. When this occurs, both locking members, 110L and 110R, engage and lock their respective gears, 114L and 114R. In FIG. 2B, the level condition is indicated by dashed line 118. Line 148 is parallel to the top edge of the frame leveler, which is not level, but rather, tilted up from level on the right side and tilted down from level on the left side of the frame. Angle 122 is greater than 90 degrees and angle 124 is less than 90 degrees with respect to line 120, which indicates the direction of gravity, and thus the direction sought by bob members 106.

Figure 3A:
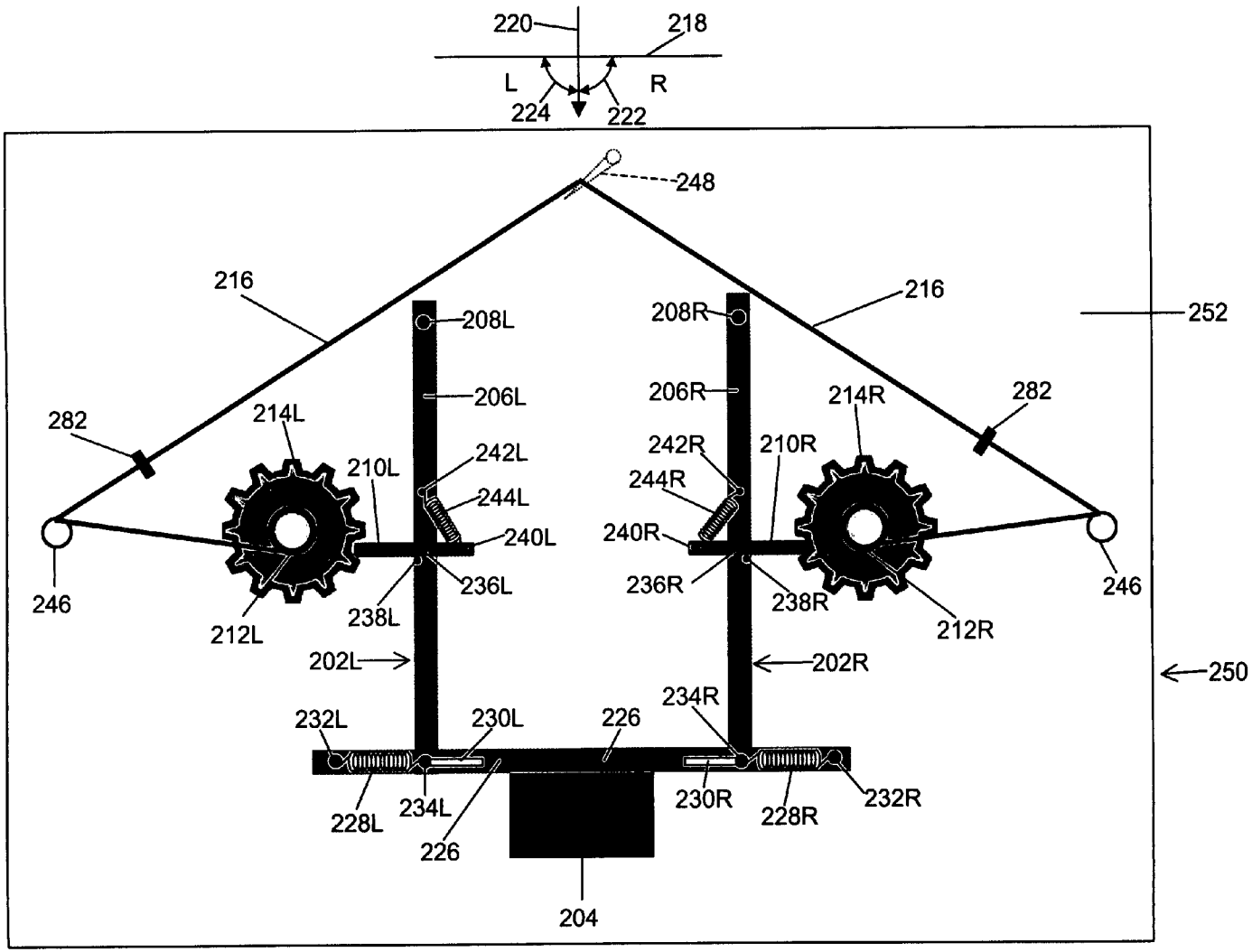
FIG. 3A shows the frame leveler with two locks, two reels, but one bob weight with a frame that is level.
Figure 3B:
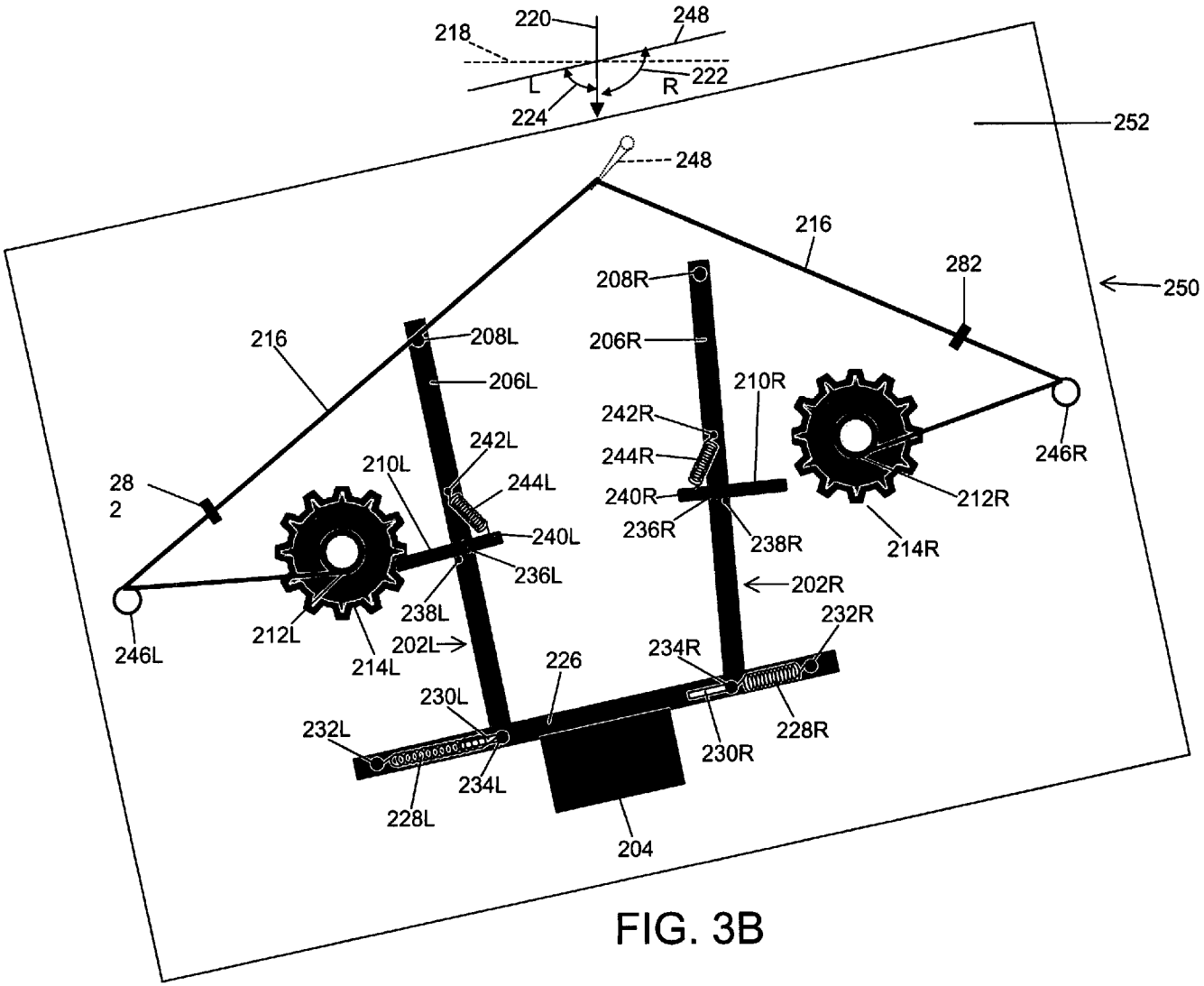
FIG. 3B shows the frame leveler with two locks, two reels, and one bob weight with a frame that is not level.

FIGS. 3A and 3B illustrate an alternative embodiment of the present invention. In this embodiment, only one weight, 204, is used to serve the gravity seeking purposes of two bob members, 202L and 202R. FIG. 3A shows the level condition where the top edge of the frame leveler 250, suspended from wall hanger 248, is perpendicular with respect to the direction of gravity. In the level condition, both bob members 206L and 206R, shown generally longitudinally parallel to the direction of gravity, are pivotably suspended from pivots 208L and 208R, respectively, which are attached to support 252 of the frame leveler 250. As shown, locking members 210L and 210R lock reels 212L and 212R by engaging and locking gears 214L and 214R, respectively. Thus, angles 222 and 224 formed between line 218, which is parallel to the level condition, and line 220, which is parallel to the direction of gravity, are each 90 degrees. In FIG. 3A, weight 204 is attached to horizontal weight member 226. Horizontal weight member 226 is slidably attached to each bob member 206L and 206R with pins 234L and 234R, which are attached to bob members 206L and 206R, respectively. Pins 234L and 234R are slidably attached to horizontal weight member 226 through slots 230L and 230R. Pins 234L and 234R are urged to the lateral sides of slots 230L and 230R with springs 228L and 228R, which are attached to horizontal weight member 226 by lugs 232L and 232R and bob members 206L and 206R by pins 234L and 234R. The weight of weight 204 is enough so that, in a non-level condition of the frame, it is able to overcome the tension of springs 228L or 228R and cause horizontal weight member 226 to shift slidably in the direction of the side that is tilting down with respect to the other side. This causes locking member 210L or 210R on the side that is tilting up with respect to the other side to disengage its gear 214L or 214R, while locking member 210L or 210R on the side that is tilting down with respect to the other side continues to engage, and, therefore, lock gear 214L or 214R of its side. The weight of weight 204 is also enough so that, in the non-level condition of the frame, pins 234L and 234R easily slide within slots 230L and 230R. That is, friction between the slots 230L and 230R of horizontal weight member 226 and pins 234L and 234R is minimized through lubrication, choice of materials, or other means known in the mechanical art. Further, members with a left side orientation of 238L, 236L, 240L, 244L, and 242L of FIG. 3A, respectively, act along 208L and also the right side orientation of 246, 238R, 236R, 240R, 244, and 242R, respectively, acting along 208R in a similar manner as known to those skilled in the art to the following members 138L, 136L, 140L, 144L, and 142L, of FIG. 2A, respectively, along 108L as well as 138R, 136R, 140R, 144R, and 142R, respectively, act along 108R in a similar manner as well.

FIG. 3B shows the single weight alternative embodiment with the frame leveler 250, (suspended from wall hanger 248) tilted up on the right side and tilted down on the left side. This condition is shown by angles 222 and 224, which are formed by line 248, parallel to the top edge of frame 250, and line 220, parallel to the direction of gravity. On the left side (L) tilting down with respect to the right side (R), angle 224 is less than 90 degrees. On the right side (R) tilting up with respect to the left side (L), angle 222 is greater than 90 degrees. Dashed line 218 represents the level condition from which frame leveler 250 is shown to have deviated.

In FIG. 3B, horizontal weight member 226, under the influence of gravity responsive weight 204, has shifted down and to the left. While pin 234L has slid within slot 230L from the left side of slot 230L to the right side of slot 230L and extended spring 228L, locking member 210L has continued to engage and lock gear 214L thereby retaining a lock on reel 212L and the left side of cable 216. Concomitantly, locking member 210R on the right side of support 252 of the frame leveler 250 has pulled away from and disengaged gear 214R, which is now unlocked, thereby freeing reel 212R to let out cable 216 on the right side of the frame leveler 250 through screw eye 246R due to the pull of gravity on frame leveler 250. Pin 234R has remained on the right side of slot 230R as the bob member 206R follows the gravity seeking weight 204 attached to horizontal weight member 226. As cable 216 is let out by reel 212R on the right side of frame leveler 250, the apparatus returns to the level configuration shown in FIG. 3A. Reels 212L and 212R each include an internal spiral spring (not shown) that urges each reel 212L and 212R to take up or retract cable 216 in the same way as was already discussed for the preferred embodiment. Cable stops 282 prevent the uneven uptake of cable 216. Further still, regarding the following members 246L, 236L, 240L, 244L, and 242L, respectively, act along 208L in association with 246L of FIG. 3B as well as 236R, 240R, 244R, and 242R, respectively, act along 208R in a similar manner to the following members 146L, 136L, 140L, 144L, and 142L, respectively, along 108L and also the right side orientation members or 146R, 136R, 140R, 144R, and 142R, respectively, along 108R as known to those skilled in the art, in a similar manner as well.

Figure 4A:
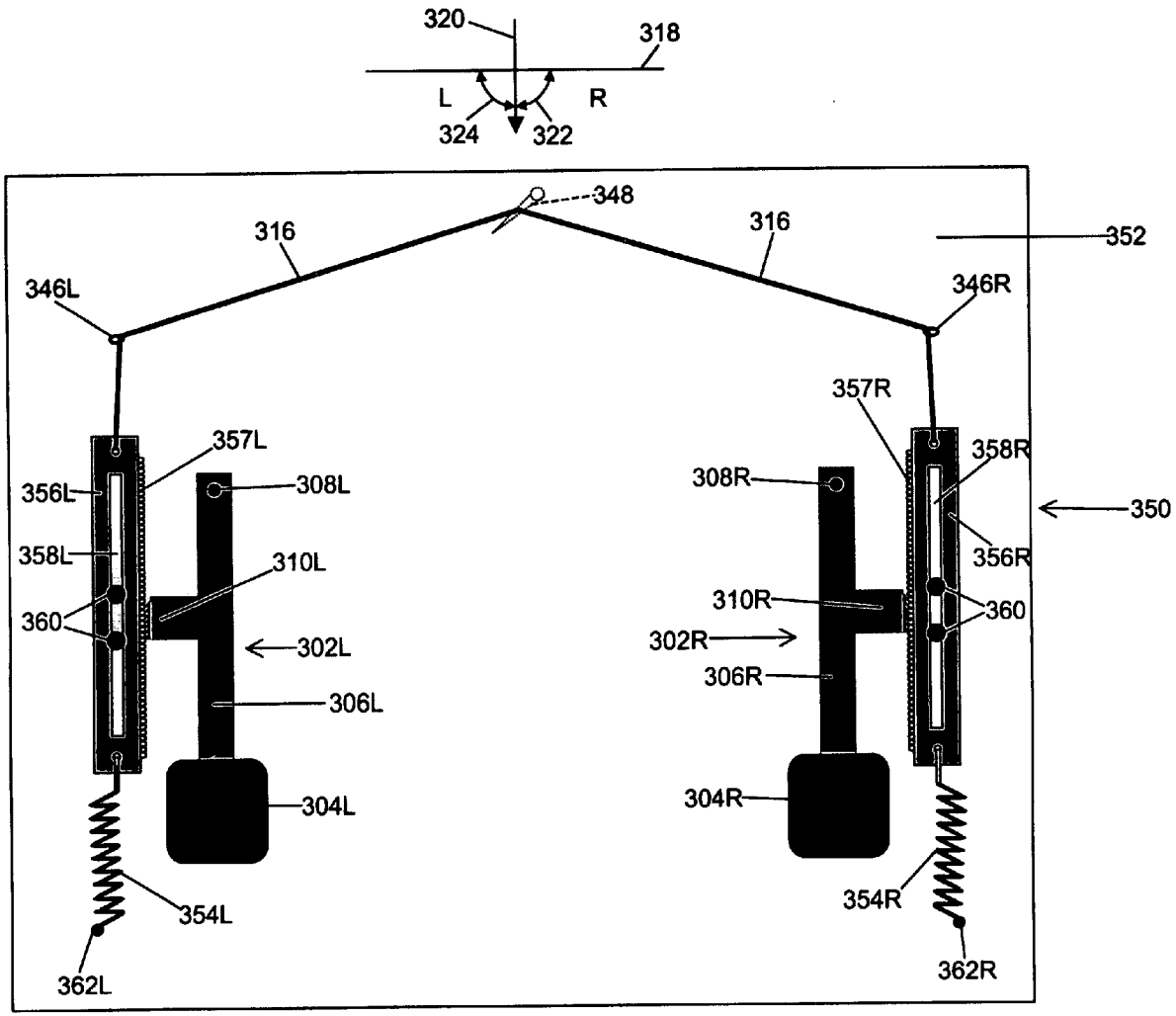
FIG. 4A shows an embodiment of the frame leveler with two lockable toothed linear slide members that are spring retractable.
Figure 4B:
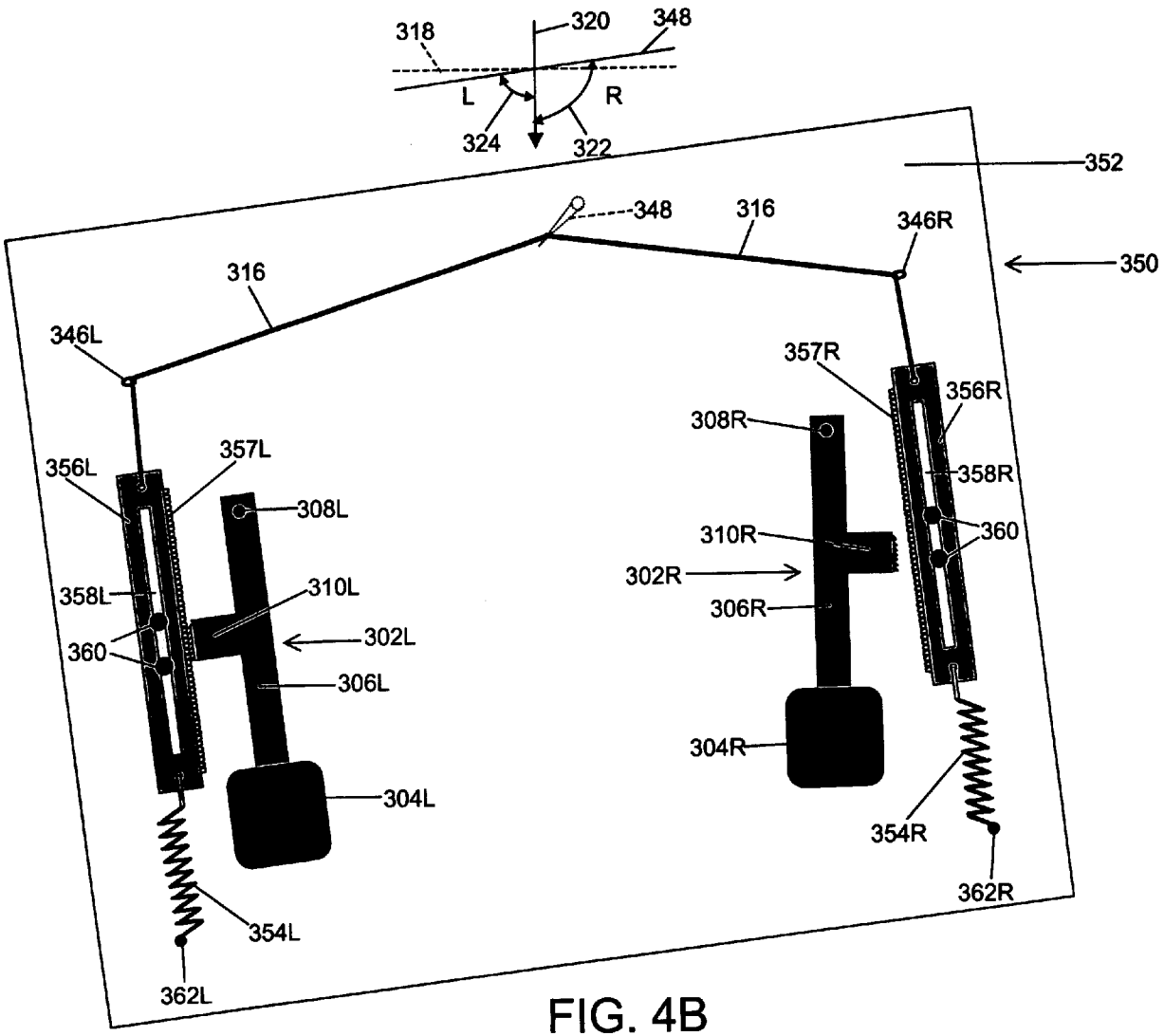
FIG. 4B shows this embodiment when it is not level.

The alternative embodiment of FIGS. 4A and 4B is an apparatus for leveling a frame that operates without a reel and gear based locking mechanism. Instead, this embodiment employs two lockable toothed linear slide members, 356L and 356R each on its medial side having teeth 357L and 357R, respectively. FIG. 4A shows the apparatus in a level condition indicated by angles 322 and 324, which are both 90 degrees and formed by the intersection of line 320, which is parallel to the direction of gravity, and line 318 which is parallel to the top edge of the frame leveler 350. When the frame leveler 350 is level, both locking members 310L and 310R, extending from bob members 306L and 306R, respectively engage and lock the teeth 357L and 357R of linear slide members 356L and 356R. The frame leveler 350 is hung symmetrically from wall hanger 348 by cable 316, each end of which is attached to the top of a linear slide member 356. Cable 316 is slidably directed through screw eyes 346L and 346R. Lugs 360 extend out from the support 352 of the frame leveler 350 slidably through slots 358L and 358R and thereby secure linear slide members 356L and 356R to the support 352 of frame leveler 350. Bobs 302L and 302R are made up of weights 304L and 304R, which are attached to bob members 306L and 306R, respectively, attached pivotably to the support 352 of frame leveler 350 by pivots 308L and 308R. Bob members 306L and 306R are capable of pivoting away from linear slide members 356L and 356R, respectively, under the influence of gravity and tilt of the frame leveler 350, thereby disengaging locking members 310L or 310R from and, thus, unlocking linear slide members 356L or 356R. Springs 362L and 362R are able to retract linear slide members 356L and 356R and cable 316 down on each side only when the weight of the frame leveler 350 is supported and lifted. Otherwise, the weight of the frame leveler 350 and the locked linear slide members 356L and 356R overcome the ability of springs 362L and 362R to retract cable 316 down on each side.

FIG. 4B shows the frame 350 tilted up on the right (R) side and down on the left (L) side. In this configuration, dashed line 318 represents the level condition. Line 348, which is parallel to the top edge of the frame leveler 350 intersects with line 320, which is parallel to the direction of gravity, to form left (L) angle 324, which is less than 90 degrees, and right (R) angle 322, which is greater than 90 degrees. Thus frame 350 is tilted up on the right side and tilted down on the left side. As such, left bob member 306L under the influence of gravity pulling on weight 304L, urges locking member 310L against toothed linear slide member 356L, thereby locking it in place. Right bob member, under the influence of gravity pulling on weight 304R has pivoted, on pivot 308R, locking member 310R away from toothed linear slide member 356R, thereby unlocking it and freeing it to move up due to the weight of frame leveler 350. Thus, as toothed linear slide member 356R moves up, the amount of cable 316 on the right side of frame 350 between wall hanger 348 and screw eye 346R increases and various angles change so the frame leveler 350 becomes level again. Once frame leveler 350 is level, locking member 310R again locks toothed linear slide member in place in its new position and spring 354R is further extended.

Figure 5:
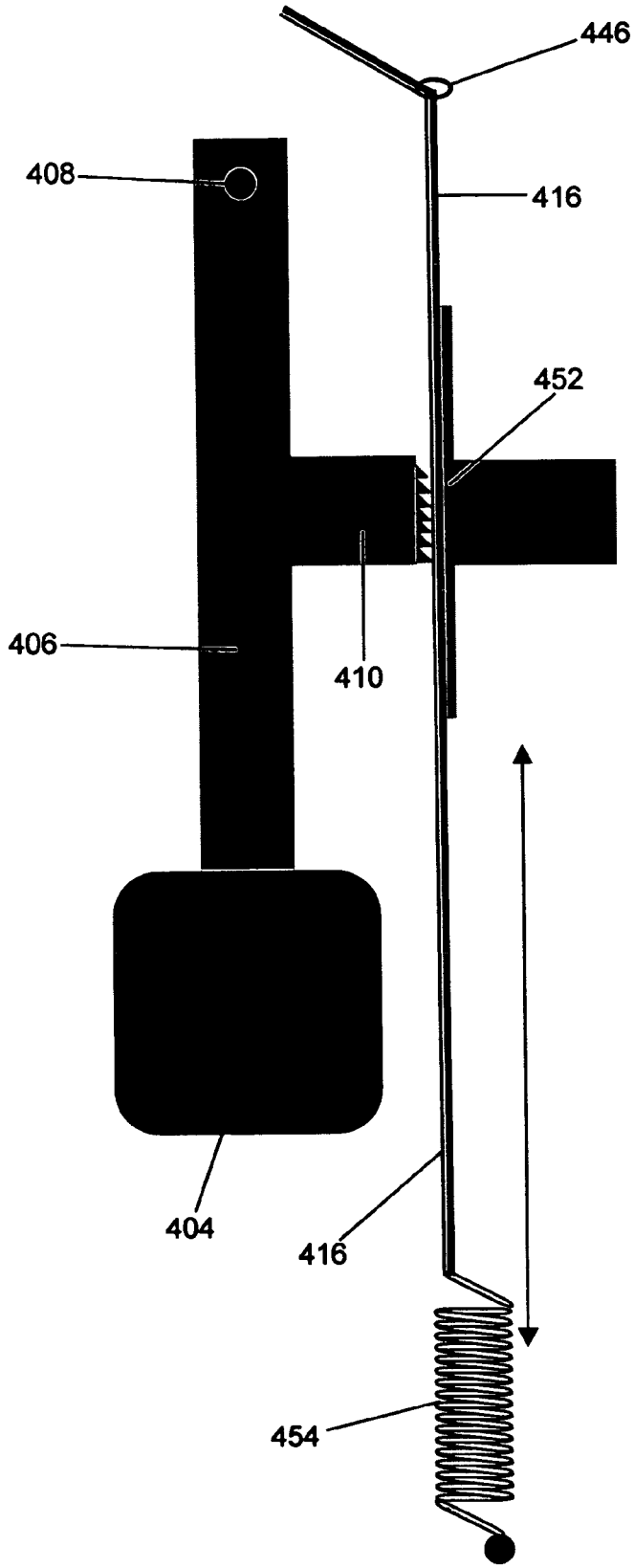
FIG. 5 shows an alternative lock arrangement with a spring instead of a take-up reel and gear locking mechanism.

The alternative embodiment of FIG. 5 is an apparatus for leveling a frame that also operates without a reel and gear locking mechanism. Bob 402 is formed of weight 404, attached to bob member 406 pivotally suspended from pivot 408, which is attached to a frame (not shown). Locking member 410 engages cable 416 against cable guide 452, locking it when the frame is level or tilted down toward the side of the frame supported by cable 416, as shown. Cable 416 is connected at one end to spring 454, which urges retraction of cable 416 in the downward direction. The tension of spring 454 is such that spring 454 is easily stretched by the weight of the frame leveler if cable 416 is unlocked and free to move. Thus, spring 454 is capable of retracting an unlocked cable 416 only when the weight of the frame is supported and lifted manually or otherwise. Cable 416, which supports the frame, easily moves through screw eye 446. Cable 416 can include a pattern of locking notches or grooves to facilitate locking engagement with locking member 410.

As a variation of the alternative embodiment of FIG. 5, instead of using a spring 454, as shown, a spiral spring-powered reel could be used to take up or let out cable 416. Unlike the take up reels of the preferred embodiments already discussed, this reel would not have a gear and locking function associated with it. Locking member 410 would be used to engage line 416 as shown in FIG. 5.

Figure 6:
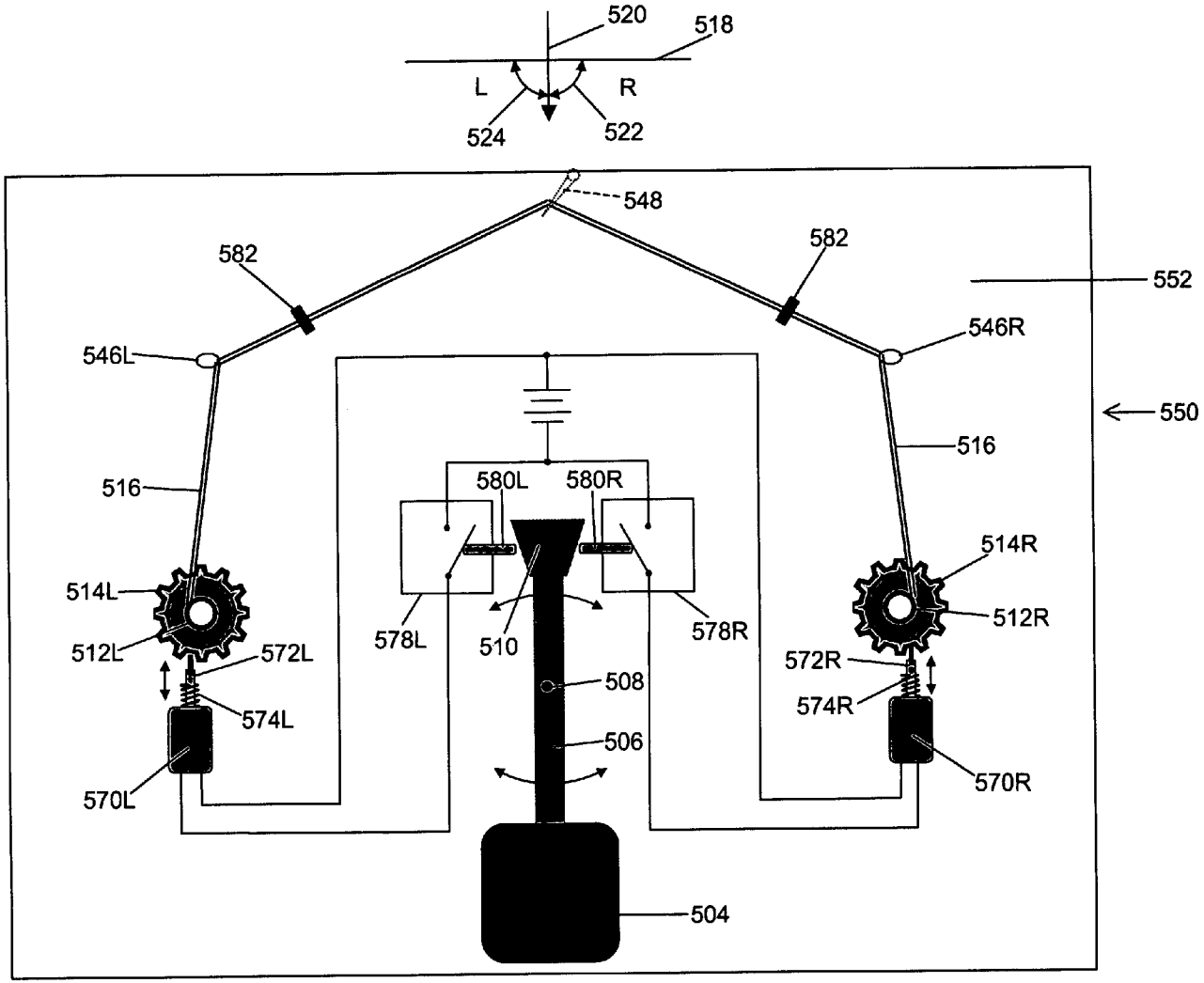
FIG. 6 shows an alternative embodiment of the present invention that uses an electromagnetic locking means.

FIG. 6 shows an alternative embodiment of the present invention that uses an electromagnetic locking means. More specifically, latching solenoids 570L and 570R normally extend solenoid shafts 572L and 572R, respectively, under the urging of solenoid springs 574L and 574R when solenoids 570L and 570R are not energized. When solenoid shafts 572L and 572R are extended, they engage gears 514L and 514R respectively and, thereby, lock them. Take up reels 512L and 512R are concentrically attached to gears 514L and 514R, respectively, and function to take up and let out cable 516 by rotation. The position of bob member 506 in relation to the orientation of frame 550 determines whether switches 578L or 578R are closed. In operation, if the top edge of frame 550 is level, it is perpendicular to the longitudinal direction of bob member 506 and neither switch 578L nor 578R is closed. If the left (L) side of frame 550 is tilted up with respect to the right side, then the top edge of frame leveler 550 is no longer perpendicular to the longitudinal direction of bob member 506, and switch member 580L is pushed by the pivoting movement of locking member 510 and switch 578L is closed. When switch 578L is closed, solenoid 570L is energized by battery 584 and solenoid shaft 572L is retracted, spring 574L is compressed and gear 514L is unlocked. When gear 514L is unlocked, reel 512L is free to let out cable 516 on the left (L) of frame 550. Cable 516 on the left side of the frame is let out, thereby allowing the top edge of the frame on the left side to drop until it is again perpendicular to the longitudinal direction of bob member 506. At this point, locking member 510 pivots away from switch member 580L causing switch 578L to open. When switch 578L opens, solenoid 570L is no longer energized and spring 574L returns solenoid shaft 572L to its extended position, which locks gear 514L, preventing reel 512L from letting out more of cable 516. If the right (R) side of the top of the edge of frame leveler 550 is pointing up with respect to the left (L) side, and the angle between the right side of the top edge of frame leveler 550 and the downward longitudinal direction of bob member 506 is greater than 90 degrees, then switch 578R is engaged, thereby energizing solenoid 570R, which unlocks gear 514R and reel 512R lets out cable 516 on the right side of the frame until the frame is once again level.

Not shown is an over-ride switch, which energizes both solenoids 570L and 570R concurrently so that both reels 512L and 512R can be unlocked and the weight of the frame can be supported and lifted to allow both reels 512L and 512R to take up line 516 on both sides. Reels 512L and 512R each include an internal spiral spring (not shown) that urges each reel 512L and 512R to take up or retract line 516. Cable stops 582 prevent the uneven uptake of cable 516.

As an alternative to the use of a bob as a gravity reference, an electronic bubble level can be used in the solenoid-based embodiment of the present invention.

In general, the method of the present invention involves providing a frame leveler with a gravity reference and, on a first side of the frame leveler, a locked extensible cable that is automatically unlocked when the first side of the frame leveler is tilted up with respect to the second side of the frame leveler as determined by the gravity reference. When unlocked, the extensible cable is allowed to extend under the influence of gravity. Finally, the extensible cable is locked when the first side of the frame leveler is no longer tilted up with respect to the second side of the frame leveler.

The foregoing examples have been provided merely for the purpose of explanation and are in no way to be construed as limiting of the present invention. While the present invention has been described with reference to a preferred embodiment, it is understood that the words that have been used herein are words of description and illustration, rather than words of limitation. Changes may be made within the purview of the appended claims, as presently stated and as amended, without departing from the scope and spirit of the present invention in its aspects. Although the present invention has been described herein with reference to particular methods, materials, and embodiments, the present invention is not intended to be limited to the particulars disclosed herein, rather, the present invention extends to all functionally equivalent structures, methods and uses, such as are within the scope of the appended claims.

I claim:

1. An automatic frame leveler, comprising:

a. a frame support having at least a first side and a second side;

b. a first pivotable bob pivotably attached to said frame support by a first support pivot, and a second pivotable bob pivotably attached to said frame support by a second support pivot, each of said first and second bobs comprised of an elongated bob member having a first end and a second end, said first end attached to the support pivot, and said second end attached to a weight, wherein said support pivot is freely moveable to align the elongated bob member longitudinally parallel to the direction of gravity;

c. a first spring attached to the first bob and a second spring attached the second bob, said first spring attached to a first locking member, said first locking member in operative association with a first take-up reel, said first take-up reel attached to the frame support and having toothed gears for interacting with said first locking member to provide a first pawl and ratchet mechanism, said second spring attached to a second locking member, said second locking member in operative association with a second take-up reel, said second take-up reel attached to the frame support and having toothed gears for interacting with said second locking member to provide a second pawl and ratchet mechanism;

d. an extensible cable having a first end and a second end, said first end mounted on said first take-up reel, said cable threaded through one or more cable guides attached to the frame support, and said second end mounted on said second take-up reel;

wherein when the first side of the frame support is tilted higher than the second side, the first pivotable bob will temporarily disengage from the first take-up reel by swinging away from the first take-up reel and removing the first locking member from the toothed gears of the first take-up reel, upon disengagement of the first locking member the take-up reel will wind a length of the cable pulling the first pivotable bob back into proximity with the first take-up reel at which time the first spring will reengage the first locking member into the toothed gears of the first take-up reel, and wherein when the second side is tilted higher, the same mechanism reestablishes proper alignment from the second bob and reel action, wherein the frame leveler maintains a level orientation without requiring the intervention of a person to readjust the frame to a level position.

2. The automatic frame leveler of claim 1, further comprising wherein the first elongated bob member and the second elongated bob member use a common weight.

3. An automatic frame leveler, comprising:

a. a frame support having at least a first side and a second side;

b. a first pivotable bob pivotably attached to said frame support by a first support pivot, and a second pivotable bob pivotably attached to said frame support by a second support pivot, each of said first and second bobs comprised of an elongated bob member having a first end and a second end, said first end attached to the support pivot, and said second end attached to a weight, wherein said support pivot is freely moveable to align the elongated bob member longitudinally parallel to the direction of gravity, and wherein each of said first and second bobs has a toothed locking member attached to their elongated bob members;

c. a first spring attached on a distal end to the first side of the frame support and on a proximal end to a first lockable toothed linear slide member, a second spring attached on a distal end to the second side of the frame support and on a proximal end to a second lockable toothed linear slide member, said first lockable toothed linear slide member in operative association with the first toothed locking member of the first bob to provide a first linear locking mechanism, said second lockable toothed linear slide member in operative association with the second toothed locking member of the second bob to provide a second linear locking mechanism, said first lockable linear slide member slidably mounted on the first side of the frame support wherein the sliding motion is substantially vertical and said second lockable linear slide member slidably mounted on the second side of the frame support wherein the sliding motion is substantially vertical;

d. an extensible cable having a first end and a second end, said first end mounted on said first lockable toothed linear slide member, said cable threaded through one or more cable guides attached to the frame support, and said second end mounted on said second lockable toothed linear slide member;

wherein when the first side of the frame support is tilted higher than the second side, the first pivotable bob will temporarily disengage from the first lockable toothed linear slide member by swinging away from the first lockable toothed linear slide member and removing the first toothed locking member from the teeth of the first lockable toothed linear slide member, upon disengagement of the first toothed locking member the second spring will exert a pulling force on the cable pulling the first pivotable bob back into proximity with the first lockable toothed linear slide member at which time the first toothed locking member will reengage the teeth of the first lockable toothed linear slide member, and wherein when the second side is tilted higher, the same mechanism reestablishes proper alignment from the second bob and spring action, wherein the frame leveler maintains a level orientation without requiring the intervention of a person to readjust the frame to a level position.

* * * * *